United States Patent [19]

Fehrs et al.

[11] 4,351,464

[45] Sep. 28, 1982

[54] COMPRESSED AIR-OPERATED FASTENER DRIVING TOOL WITH RELEASE SAFETY MEANS

[75] Inventors: Hellmuth Fehrs, Hamburg; Wolfgang Elliesen, Ahrensburg, both of Fed. Rep. of Germany

[73] Assignee: Joh.Friedrich Behrens AG, Ahrensburg, Fed. Rep. of Germany

[21] Appl. No.: 155,947

[22] Filed: Jun. 3, 1980

[30] Foreign Application Priority Data

Apr. 17, 1980 [DE] Fed. Rep. of Germany ..... 3014803

[51] Int. Cl.[3] ..... B27F 7/02; B27F 7/34

[52] U.S. Cl. ..... 227/7; 227/8; 227/132

[58] Field of Search ..... 227/8, 9, 7, 132

[56] References Cited

U.S. PATENT DOCUMENTS

| | | | |
|---|---|---|---|
| 3,893,610 | 7/1975 | Smith | 227/8 |
| 4,084,738 | 4/1978 | Schneider | 227/7 |
| 4,161,271 | 7/1979 | Bussard | 227/8 |
| 4,189,080 | 2/1980 | Smith et al. | 227/8 |
| 4,194,664 | 3/1980 | Siegmann | 227/8 |
| 4,257,548 | 3/1981 | Stubbings | 227/8 |

*Primary Examiner*—Paul A. Bell

*Attorney, Agent, or Firm*—Bucknam and Archer

[57] ABSTRACT

The invention relates to a compressed air-operated fastener driving tool comprising a pilot valve controlled by a manually actuated release lever, a control valve, the pressure bias of which is controlled by the pilot valve and which for its part controls the supply of compressed air to a working cylinder, and a release barrier adapted to be actuated by the workpiece by means of which the actuation of the pilot valve is adapted to be controlled in common with the release lever when placed in its working position.

10 Claims, 2 Drawing Figures

COMPRESSED AIR-OPERATED FASTENER DRIVING TOOL WITH RELEASE SAFETY MEANS

A compressed air-operated fastener driving tool comprising a pilot valve controlled by a manually actuated release lever, and a control valve controlled by said pilot valve is known (German disclosure letter No. 2 131 849). The release safety means usually comprises a release sensor at the mouthpiece of the fastener driving tool which is mechanically connected with a release valve lever or an auxiliary valve. The release sensor projects above the mouthpiece of the fastener driving tool and is pushed back when the mouthpiece gets seated on a workpiece. The release sensor will block the release of the fastener driving tool and thus a working stroke as long as it is not pushed back.

With the known release safety means it is intended to prevent the release of a blow before the compressed air-operated fastener driving tool is brought together with the workpiece. But the release safety means cannot prevent the release of a blow when the release sensor strikes against any other object. This, for example, may also be the other hand of the operator because both release organs of the compressed air-operated fastener driving tool, namely the release sensor and the actuation lever may be released by one hand seizing the fastener driving tool. This danger is very high in particular when in operation the contact release sensor is used as the release organ proper while the actuating lever remains constantly actuated.

Besides, a release safety means has already become known for compressed air-operated fastener driving tools which is not in a position to release repetitions of the working cycle as an active control organ, when all the other control organs remain in their position of actuation (German publication letter No. 2 718 942). This will be obtained with a special auxiliary safety valve which is manually operable and in its inoperative condition blocks the venting line.

In one embodiment of the known compressed air-operated fastener driving tool the safety valve is arranged in the cap of the fastener driving tool and is adapted to be actuated by means of a lever pivotally connected to the cap, said lever being actuable for its part with the aid of an actuating arm projecting into the neighbourhood of the trigger lever. Thus, the known release safety means is indeed suited to prevent a working cycle when the actuating lever remains actuated, however, it cannot prevent the release of a blow or shot when the contact release sensor gets seated on some other object, for example, on the hand of the operator, instead of the workpiece.

This problem is solved in accordance with the invention in that there is movably fitted at the fastener driving tool casing outside the gripping region of the hand actuating the release lever a third manually actuated release organ which is effective via an opening in the fastener driving tool casing on a movable valve element of the pilot valve in such a manner that the pilot valve will be adapted to be moved into the working position only when the other hand actuates the third release organ.

While with the last described known release safety means all the release organs can be actuated by one hand, the invention consciously provides for separate actuation of the different release organs in such a manner that both hands of the operator must be used. Only when the other hand of the operator actuates the third release organ can a working stroke be released so that it is secured that the operator will safely handle the compressed air-operated fastener driving tool and will not release a shot unless the compressed air-operated fastener driving tool is securely seated on the workpiece. It is avoided above all that a shot is released into the other hand of the operator.

The cost of the two-hand safety means according to the invention for a compressed air-operated fastener driving tool is indeed very low. A pilot valve which in case of a working stroke occurring vents the control valve to the atmosphere is contained in practically any compressed air-operated fastener driving tool. The additional expense in the case of the two-hand safety means according to the invention merely consists in the provision of a release organ in such a manner that it cooperates with the movable valve element—in most cases a valve slide—of the pilot valve in such a manner that a venting of the control valve cannot take place unless the other hand of the operator actuates the third release organ.

It is particularly advantageous if, according to a further embodiment of the invention, the third release organ is constantly kept in a locking position by means of a spring. Only when the other hand of the operator actuates the release organ contrary to the spring force can the pilot valve be brought into the working position or the release position, respectively.

For the design of the release organ various constructional possibilities are imaginable. In one embodiment of the invention it is provided in this respect that the third release organ is a lever pivotally supported at the casing of the compressed air-operated fastener driving tool which is effective on the valve element of the pilot valve with the aid of a projection over the casing opening, and with the aid of a spring is constantly pressed in a direction towards the valve element, with the force of the spring being smaller than the actuating force at the valve element of the pilot control valve. That means that the pilot control valve can be moved into the working position only if the other hand of the operator pivots the lever contrary to the spring force into a position which permits of adjustment of the valve element of the pilot control valve into the venting position.

As the pilot valve vents the one pressure side of the control valve during the working stroke towards the atmosphere, a corresponding venting opening must be provided in the casing of the driving tool. It is therefore particularly advantageous if, according to another embodiment of the invention the opening in the casing of the fastener driving tool is formed by the venting opening of the pilot valve through which the one pressure side of the control valve may connected to the atmosphere with the pilot valve in its working position.

According to another embodiment of the invention it is particularly advantageous when the lever is supported on the cap of the casing of the fastener driving tool. The lever is preferably a double-armed lever pivotable by means of a bearing journal, with the one arm thereof being biased by a compression spring and the other arm provided with the projection.

In another embodiment of the invention provision is made for a handle to be fitted at the lever, preferably in the form of an ear. The handle at the lever offers the additional advantage of facilitating the handling of the apparatus especially with heavy compressed air-operated fastener driving tools.

As an alternative to the lever at the casing of the compressed air-operated fastener driving tool performing as the third release organ provision is made in another embodiment of the invention for the third release organ to be a slide or rotary element movably supported at the tool casing. Slides or rotary elements may be integrated into the casing and be equipped with an easily actuable handling means for the other hand of the operator so as to be able to selectively block or release the pilot valve.

It has to be emphasized that the release safety means according to the invention may be employed for pneumatically actuated pilot valves as well as for directly manually actuated pilot valves. With a pneumatically actuated pilot valve a release valve is actuated by the hand lever which controls the pressure bias of the slide of the pilot valve. With a directly manually actuated pilot valve a spring arrangement is preferably interposed in the path of the mechanical actuation, in order to prevent the manual actuation from overcoming also the bias of the third release organ.

An example of embodiment of the invention will be described in the following in more detail by way of the drawings.

Figure 1:
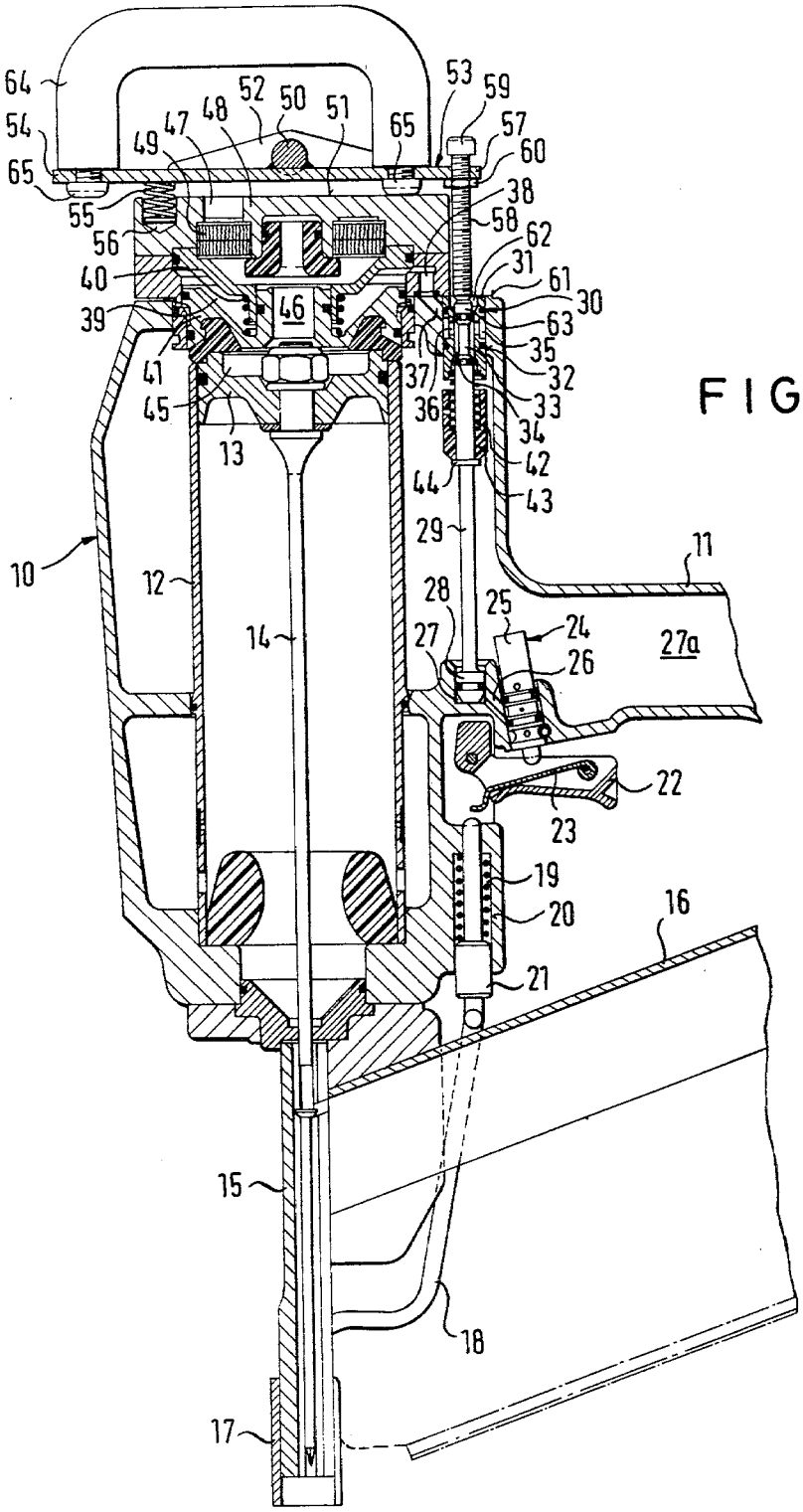
FIG. 1 shows a sectional view of the compressed air-operated fastener driving tool in its position of rest.

Prior to enlarging in more detail on the details shown in the drawings it has to be stated that each feature by itself or in connection with features of the claims is of essential inventive significance.

The compressed air-operated fastener driving tool as regards the basic elements thereof is of a generally usual construction comprising a fastener driving tool casing 10 provided with a handle 11, a working cylinder 12 in the casing 10 of the fastener driving tool, a working piston 13 with driving plunger 14, a mouthpiece 15 of the fastener driving tool as well as a magazine 16 for the fasteners. The compressed air-operated fastener driving tool furthermore comprises a contact sensor 17 arranged at the mouthpiece 15 for sliding movement and projecting downwards from the mouthpiece when in the position of rest. The contact sensor 17 is connected to a rod 18 leading to an actuating pin 21 biased by a spring 19 and guided in a bore 20 in the casing of the fastener driving tool. Spring 19 takes care that the contact sensor 17 will normally remain in the position as shown in FIG. 1.

The compressed air-operated fastener driving tool furthermore comprises a pivotable release lever 22 having another lever 23 pivotally supported therein the free end of which extends above the free end of the actuating pin 21. Above the release lever 22 there is arranged in the driving fastener tool casing a release valve 24 the valve slide 25 of which in the position of rest blocks a bore 26 vis-a-vis a reservoir 27*a* in the handle 11. The bore 26 leads to a pressure chamber 27 which is arranged by a blind bore in the valve housing and a section 28 of the piston at a valve slide rod 29 of a pilot valve 30. The pilot valve 30 is provided with a sleeve 31 which is fastened in a bore 32 of the fastener driving casing 10. The sleeve 31 guides the slide member 33 connected to the slide rod 29 which, in the position as shown, via an annular space 34, an annular groove 35 in the sleeve 31, a bore 36 in the sleeve 31 and a bore 37 in the fastener driving tool casing as well as a bore 38 in the fastener driving tool connects a pressure chamber 39 above the control valve 41 biased in the direction of the working cylinder 12 by a spring 40 to the reservoir 27*a*. A spring 42 supported on the one hand at the sleeve 31 and, on the other hand, at a sleeve 43 of synthetic material seated on a flange 44 of the rod 29 normally keeps the slide member 33 in the position as shown in FIG. 1. The pressure chamber 45 of the working piston 13 in this position is connected via a bore 46 in the control valve 41 as well as a channel 47 in the cap 48 of the compressed air-operated fastener driving tool casing 10 to the atmosphere. A silencer 49 is situated in the channel 47.

A pin 50 extending approximately in parallel spaced relationship with the upper surface 51 is pivotally supported by bearings portions (not shown) of the cap 48. The pin 50 extends through a bore of two brackets 52 which for their part are fastened on the upper surface 51 of the cap 48 on both sides of the lever 53. The pin 50 is, besides, non-rotatably connected to the lever 53. The lever 53 has two arms, namely an arm 54 biased from below by the spring 55 seated in a blind bore 56 of the cap 48, and an arm 57. The arm 57 has a bore with a locking pin 58 extending therethrough which comprises a head 59 and which is provided with a nut 60 screwed onto it. The head 59 and the nut 60 allow for a limited possibility of movement of the locking pin 58.

The locking pin 58 extends in parallel with the axis of the working cylinder beside the cap 48 in a direction downward towards a shoulder 61 of the fastener driving tool casing having the bore 32 formed therein. The free end of the locking pin 58 extends into the upwards opening bore 63 of the sleeve 31 and comes to lie in close contact against the upper head 63 of the valve slide 33 with the pressure as predetermined by the spring 55.

An ear-like handle 64 is fastened at the lever 63 with the aid of two screws 65 and serves as a carrying handle to facilitate the handling of the compressed air operated fastener driving tool as shown.

Figure 2:
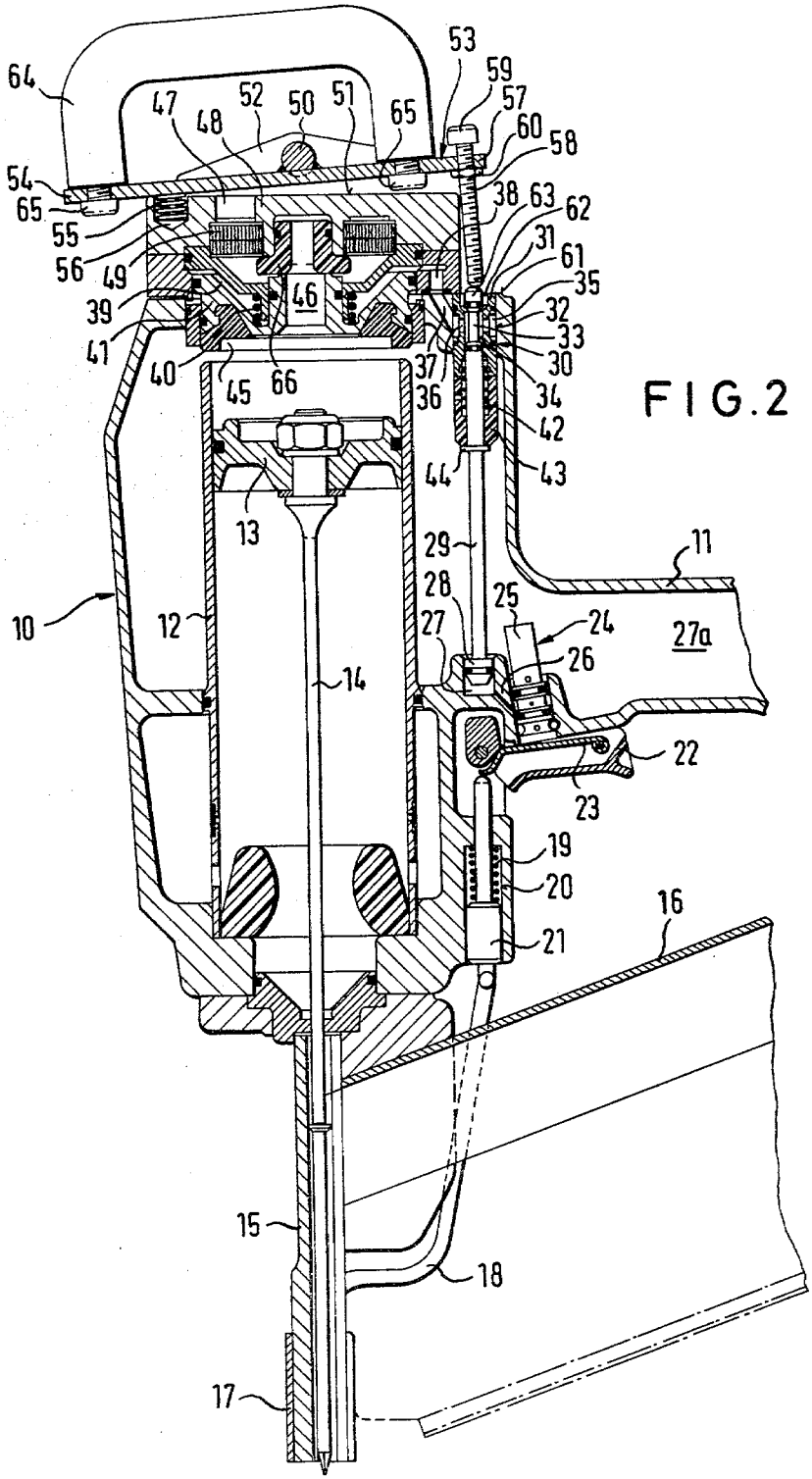
FIG. 2 shows the same view as FIG. 1, however, with the compressed air-operated driving tool in its operative position.

The mode of operation of the compressed air-operated fastener driving tool as shown is as follows:

If an operator actuates only the lever 23 (see FIG. 2) this will not yet lead to an actuation of the release valve 24, as long as the contact sensor 17 remains in the position as shown in FIG. 1. If the latter is likewise actuated by being seated onto a workpiece, the actuation pin 21 will lift the second lever 23 so much that the release valve 24 may be actuated. Owing thereto, compressed air may pass into the pressure chamber 27 from the reservoir 27*a* via the bore 26 and can urge the sealingly guided piston 28 upwards with the slide rod 29. The piston 28, however, as regards the effective area thereof is dimensioned in such a manner that the pressure will not suffice to adjust the slide rod 29 in an upward direction against the force of the spring 55, rather, it will remain in the position as shown in FIG. 1. This means that the release of a working stroke of the position 13 does not take place, when only the release lever 22 and the contact sensor 17 have been actuated. Only when, by seizing the handle 64, the lever 55 is pivoted into the position as shown in FIG. 2 against the force of the spring 55 will the pressure in the pressure chamber 27 be able to adjust the slide rod 29 to assume the position as shown in FIG. 2 so that the pressure chamber 39 of the control valve 41 which had been biased with pressure from the reservoir 27*a* before, will now be vented via the bore 37, the bore 36, the annular space 34 and the opening 62. Thereby, the pressure in the pressure chamber 27*a* is in a position to lift the control valve 41 against the force of the spring 40 and establish a communication of the pressure chamber 45 above the working piston 13 with the pressure chamber 27*a*, so that the piston 13 may perform a working stroke.

In the case of the position as shown in FIG. 2 the control valve 41 has an annular projection lying in close contact against a sealing element 66 in the cap 48 and interrupts a communication of the bore 46 in the control valve 41 with the exhaust channel 47.

We claim:

1. Compressed air-operated fastener driving tool comprising a pilot valve controlled by a manually operated release lever, a control valve the pressure bias of which is controlled by the pilot valve and which for its part control the supply of compressed air to a working cylinder, and a release barrier actuated by the workpiece by means of which in common with the release lever placed in the working position the actuation of the pilot valve is adapted to be controlled; and in addition to said pilot valve and control valve a third manually operable release organ movably fitted at the fastener driving tool casing outside the gripping region of the operator's hand actuating the release lever which is effective on a movable valve element of the pilot valve via an opening in the fastener driving tool casing in such a manner that the pilot valve is capable of being moved into the working position only if the other hand of the operator actuates the third release organ, said third release organ being a lever pivotally supported at the fastener driving tool casing which with the aid of a projection over the casing opening is effective on the valve element of the pilot valve and with the aid of a spring is constantly urged in a direction towards the valve element, the force of the spring being greater than the actuating force at the valve element of the pilot valve.

2. Compressed air-operated fastener driving tool according to claim 1, wherein the third release organ is constantly retained in the blocked position by means of said spring.

3. Compressed air-operated fastener driving tool according to claim 1, wherein the opening in the fastener driving tool casing is formed by a vent opening of the pilot valve through which the one pressure side of the control valve is connected to the atmosphere when the pilot valve is in its operative position.

4. Compressed air-operated fastener driving tool according to claim 2, wherein the lever is supported on a cap of the fastener driving tool casing.

5. Compressed air-operated fastener driving tool according to claim 4, wherein there is provided a double-armed lever pivotally supported by means of bearing journals the one arm of which is biased by a compressed spring and the other arm of which comprises the projection.

6. Compressed air-operated fastener driving tool according to claim 5, wherein the spring is countersunk in a recess of said cap.

7. Compressed air-operated fastener driving tool according to claim 4, including a handle fitted at said lever.

8. Compressed air-operated fastener driving tool according to claim 1, wherein said third release organ is a slide element pivotally supported at the fastener driving tool casing.

9. Compressed air-operated fastener driving tool according to claim 1, wherein said pilot valve is adapted to be pneumatically operated via a manually operated release valve.

10. Compressed air-operated fastener driving tool according to claim 1, wherein said pilot valve is capable of being actuated by the release lever via a release spring, the force of the release spring being smaller than the biasing force of the spring biasing the third release organ.

* * * * *